US005698824A

United States Patent [19]

Platt

[11] Patent Number: 5,698,824

[45] Date of Patent: Dec. 16, 1997

[54] LIFT INSTALLATION WITH PRIMARY AND SECONDARY TRANSMITTER RECEIVER MEANS

[75] Inventor: Terence Christopher Platt, Binfield, United Kingdom

[73] Assignee: Memco Limited, Maidenhead, United Kingdom

[21] Appl. No.: 510,189

[22] Filed: Aug. 2, 1995

[30] Foreign Application Priority Data

Aug. 4, 1994 [GB] United Kingdom ..... 9415772

[51] Int. Cl.[6] ..... B66B 13/26

[52] U.S. Cl. ..... 187/317; 187/392

[58] Field of Search ..... 187/316, 317, 187/392; 250/221

[56] References Cited

U.S. PATENT DOCUMENTS

| | | | |
|---|---|---|---|
| Re. 30,719 | 8/1981 | Mills | 187/316 |
| Re. 33,668 | 8/1991 | Gray | 250/221 |
| 4,029,176 | 6/1977 | Mills | 187/316 |
| 5,142,152 | 8/1992 | Boiucaner | 250/341 |
| 5,149,921 | 9/1992 | Picado | 187/316 |

*Primary Examiner*—Robert Nappi
*Attorney, Agent, or Firm*—Cumpston & Shaw

[57] ABSTRACT

In a lift installation in which a multi-beam curtain (primary beam) extends across a lift car door opening, auxiliary transmitters direct secondary beams towards a detection zone in front of landing doors. The multi-beam curtain is intercepted by a passenger entering the lift to prevent premature door closure. However, premature closure is also prevented when a passenger stands in front of the landing doors, thereby causing some of the secondary beam to be reflected onto auxiliary receivers. This provides a low cost solution to the problem of non-detection of an obstruction in the closing path of the landing doors, but not intercepting the primary beam system and also provides an increase in the passenger convenience of the lift, as the doors are held open for a passenger approaching the lift, but not yet interrupting the primary beams.

19 Claims, 2 Drawing Sheets

LIFT INSTALLATION WITH PRIMARY AND SECONDARY TRANSMITTER RECEIVER MEANS

Figure 1:
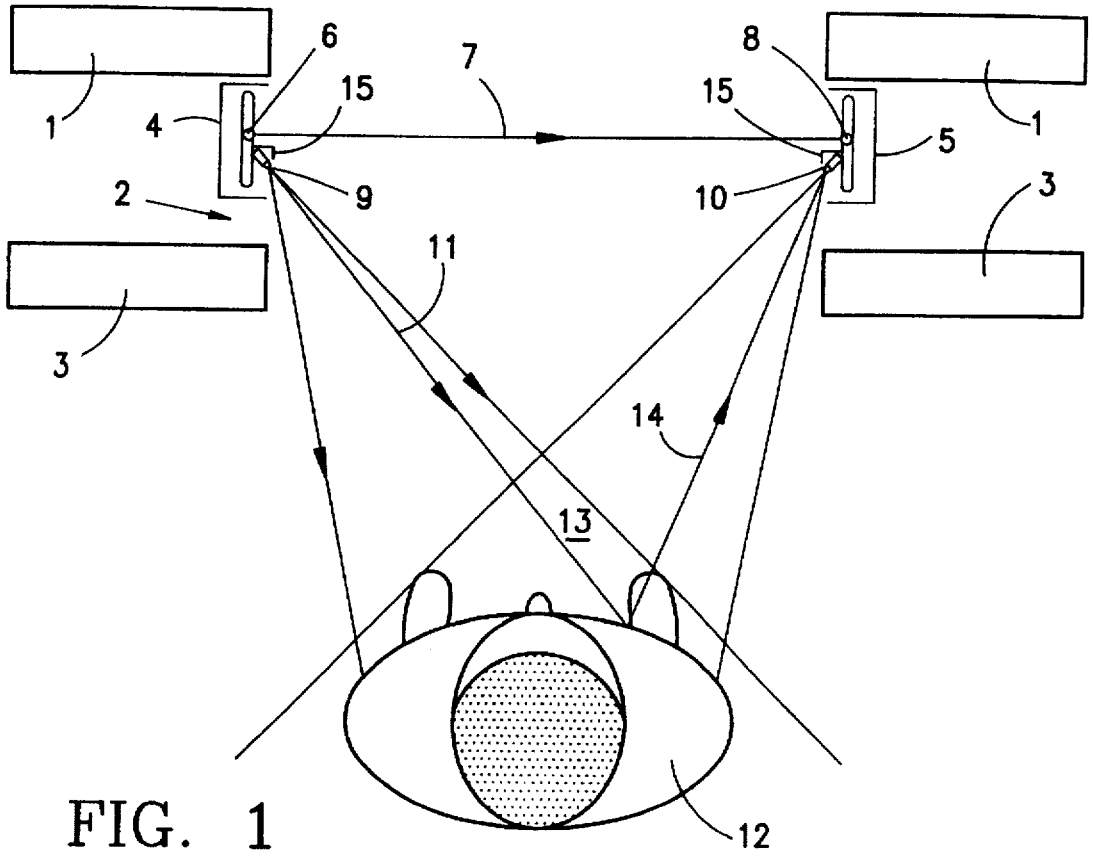

This invention relates to a lift installation and, more particularly, to apparatus which is used for controlling the movement of sliding doors in a lift car and on a floor or landing.

In a typical lift installation, a lift car travels in a hoistway between landings or floors and, at each floor, sliding lift doors and sliding landing doors open simultaneously to allow access to the lift. Usually, pairs of doors are slidably retracted apart (when open), or slidably moved together (when closed). (However, a single sliding door may close against a door post in both the lift car and the landing door opening.) The following description will refer to pairs of sliding doors, but it will be understood that the same principles apply to single sliding doors.

As well known in the art, premature closure of the sliding doors can be prevented by the interception of a beam, such as an infrared light beam, which is transmitted across the lift door frame or opening and received by a corresponding receiver or detector which is connected to circuitry controlling a motor that causes door movement. When the obstruction is removed, there is usually a brief delay before the doors are allowed to close. In order to ensure operation at different heights above floor level (e.g. to ensure detection of children, animals, or low objects), multi-beam curtains are used across the lift car doorway. These usually include an array of vertically spaced transmitters (e.g. infrared transmitting diodes),, which are arranged at one side of the lift door opening and which transmit beams to corresponding receivers (e.g. infrared responsive diodes), which are arranged in a vertically spaced array at the other side of the lift door opening. The transmitter and receiver arrays are in the form of strips, which are mounted adjacent respective closing edges of the lift car door, whereby the arrays move together with the respective doors and, when the doors are open, provide a grid of horizontal beams extending across the lift door frame or opening. If any beam is intercepted, the energy received by the detector is reduced, thereby triggering the circuitry which prevents door closure. (N.B. The term "beam" is used generally to denote any suitable form of energy, such as light, sound, or radio waves, and appropriate transmitters and receivers therefor.)

There is often a gap, of the order of 100 mm, between the landing doors an the lift car doors, this gap providing the running clearance for the lift car in the hoistway. This gap, and the fact that transmitter and receiver strips are mounted on the lift car doors (i.e. inboard of the landing doors) can cause the following problem to occur. If an obstruction is present in the closing path of the landing doors, the obstruction will not be detected unless and until it intercepts the multi-beam curtain which extends across the lift car door opening. Accordingly, in the case where a passenger does not move forwardly into a lift car, as would be expected, then (e.g.) the passenger's hand, or a child passenger, would become accidentally trapped in the landing doors when they close. Whilst this is an abnormal situation, it is nevertheless necessary to take steps to prevent any such accidents from occurring.

Although transmitter and receive strips could be fitted to each of the landing doors, on each floor, and connected to circuitry for controlling the respective landing doors to prevent such entrapment, this is not a satisfactory solution to the problem. It would be very expensive to fit such transmitter and receiver strips to the landing doors on every floor and to install the necessary circuitry to control closure of the landing doors on each floor.

The problem therefore faced by the invention is to improve the detection of an obstruction in the vicinity of the landing door opening, without adding appreciably to the cost of the lift installation.

The invention solves this problem by providing a lift installation comprising a lift car having at least one sliding door which moves across a lift car door opening; a hoistway in which the lift car moves between floors, the hoistway having at least one sliding door on each floor; primary beam transmitter means fitted to the lift car for transmitting a primary beam or beams across the lift car door opening; primary beam receiver means fitted to the lift car for receiving the primary beam or beams; and circuitry connected to the primary beam receiver means for preventing door closure when any of the transmitted primary beams is intercepted; characterised in that one or more auxiliary transmitters and receivers are fitted to the lift car so that, with the lift car and landing doors open, each auxiliary transmitter transmits a secondary beam into a detection zone outside the lift car and in front of the landing door or doors, and so that any reflection of the secondary beam, by an object in the detection zone is received by one or more of the auxiliary receivers, the auxiliary receivers being connected to the circuitry which prevents door closure; each auxiliary receiver being arranged so that it does not respond to any direct secondary beam radiation which could otherwise prevent door closure.

A particular advantage of the invention is that the auxiliary transmitters and receivers need only be fitted to the lift car door(s), so that when an object is present in the detection zone the auxiliary receiver(s) will respond to reflection of the secondary beam, thereby providing an additional measure to prevent premature door closure. This advantage would be provided, for example, in a situation where a passenger stood in front of the landing doors without entering the lift. Whilst the invention would detect the presence of such a passenger, the primary beam transmitter/receiver arrangement alone would not.

The invention also provides a low cost solution to the above noted problem, because it is only necessary to modify the transmitter and receiver strips in existing lift installations and to install circuitry which responds to both primary and second beam interception. All such equipment is normally easily accessible on the lift car.

The auxiliary transmitters and receivers are preferably disposed in a relatively staggered relationship, so as to reduce or to eliminate any response to any otherwise directly received secondary beam radiation, especially as the doors close. Such a staggered relationship may be provided in a vertical array by arranging the auxiliary transmitters and receivers at different heights above floor level.

The intensity of radiation received by the primary receivers will increase as the lift car door or doors close. In the preferred embodiment of the invention, the circuitry includes a gain adjuster responsive to the strength of the primary beam signal, to adjust gain in the processing of secondary beam signals. For example, the gain is caused to decrease as the doors close, so as to reduce the sensitivity of the auxiliary receivers.

Preferably, each auxiliary transmitter and receiver has a field of view which is inclined at an angle to the plane of the lift car door opening, an overlapping zone of said fields of view being the detection zone from which a reflection, from an object, can be received. In the case of directional transmitters and receivers, these may be inclined at approximately 45° to the plane of the lift door opening, so that their directional axes intersect at a point which is a predetermined distance away from the landing door or doors. The secondary beam of the auxiliary transmitter(s) may diverge and the field of view of the auxiliary receiver(s) may also diverge, whereby the size of the detection zone is increased. It will be appreciated that the detection zone will move gradually towards the lift car door opening as the doors close, when the auxiliary transmitters and/or receivers move with the lift car doors.

Shields may be provided to prevent any crosstalk between the primary and auxiliary beam systems.

It is possible to employ two or more groups of auxiliary transmitters and receivers disposed at different tilt angles to the primary transmitters/receivers. This will provide detection zones at different distances from the doors. As any one detection zone travels towards the doors as they close, it is possible for the zone to outrun a passenger walking towards the doors and so not detect their presence. By having two or more auxiliary groups at different tilt angles, it is possible to switch between the groups to counteract the retreating motion of the detection zones. This enables objects still be detected during the latter stages of door closure. In addition, the use of multiple auxiliary groups enables information on the motion vector of an object to be obtained. If an auxiliary group having a detection zone nearer the doors detects an object before an auxiliary group having a detection zone further out, then the object is moving away from the lift and can be ignored. If the group with the outer detection zone detects before the group with the inner detection zone, then the object is moving towards the lift and the doors should be actuated to re-open.

Figure 2:
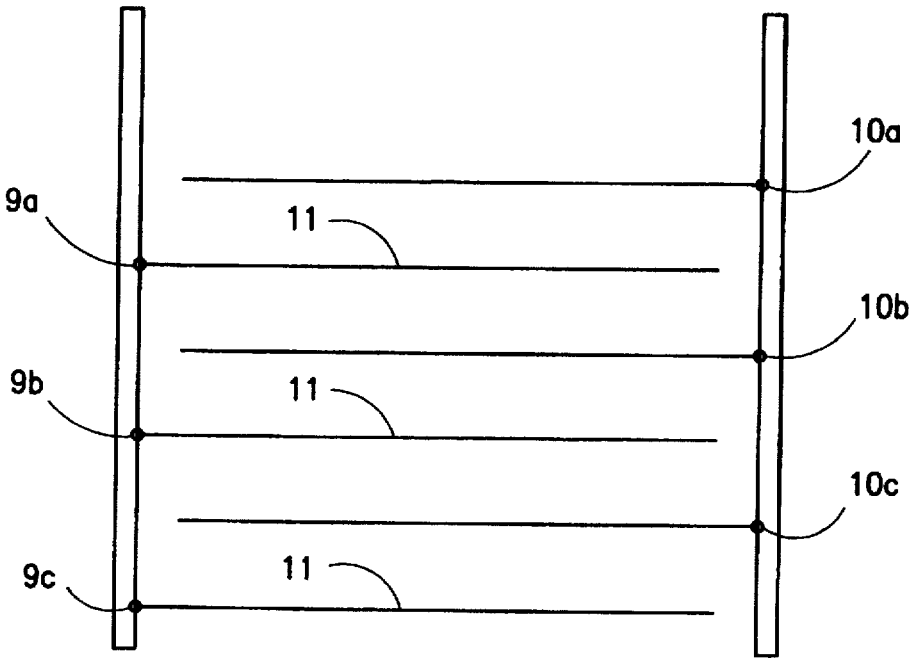
Figure 3:
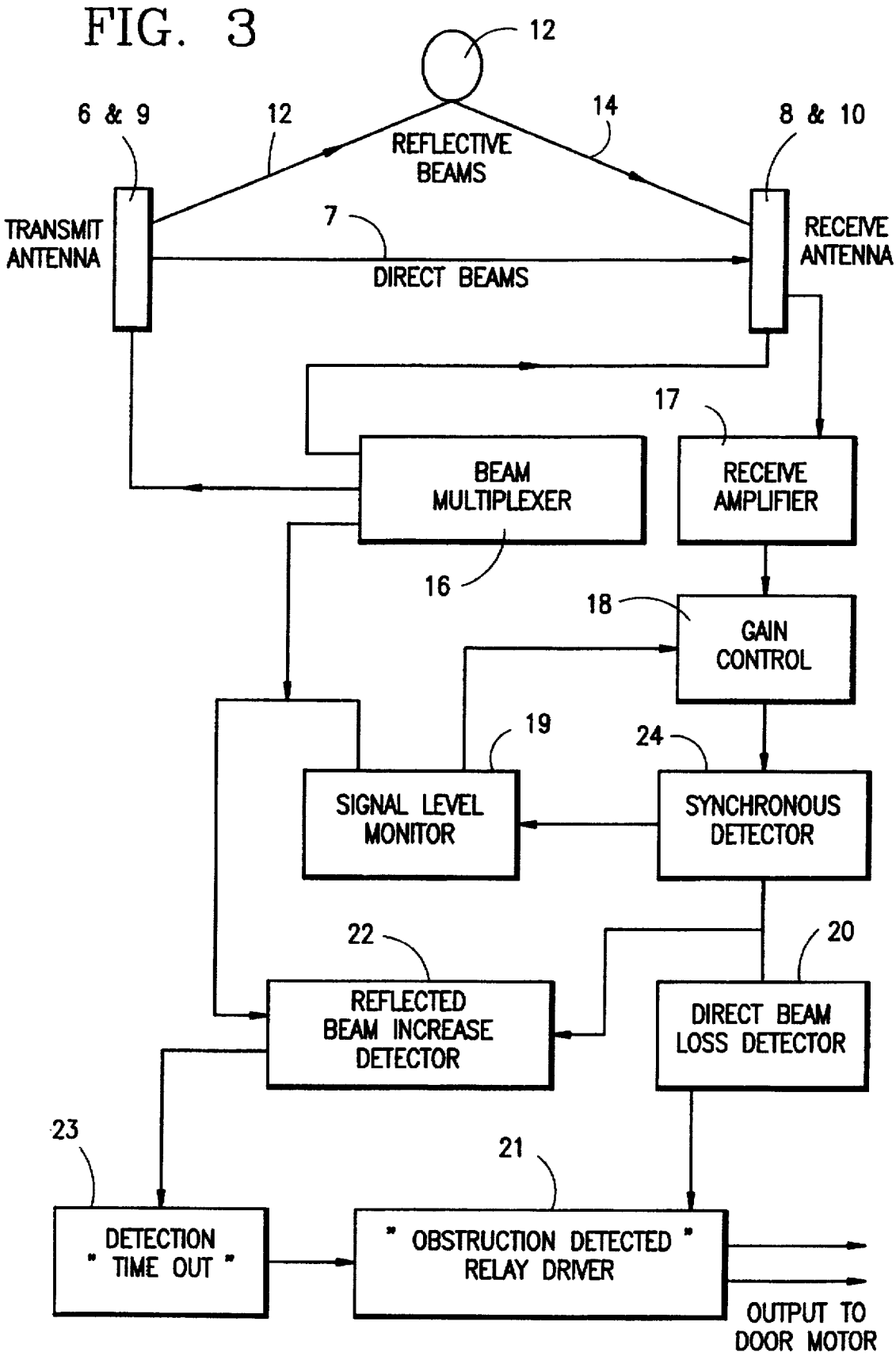

An embodiment of the invention will now be described with reference to the accompanying schematic drawings in which:

FIG. 1 is a plan view of a lift installation in accordance with an embodiment of the invention, FIG. 2 is an elevation showing the positions of transmitters and receivers, and FIG. 3 is a block circuit diagram.

Referring to the drawings, a lift car (not shown) has lift car doors 1 which are spaced, by clearance gap 2 from landing doors 3. The gap 2 approximately represents the hoistway in which the lift travels, although the running clearance is normally less than that indicated by the drawing.

Mounted adjacent the closing edge of each lift door 1 are respective strips 4 and 5. Each strip is of C-shape cross-section and it contains an array of vertically spaced transmitters or receivers. Only one of each is shown in the cross-section. Strip 4 contains transmitters 6, such as infrared light transmitting diodes. Each of these transmits a thin narrow primary beam 7 to a corresponding primary beam receiver 8, such as an infrared sensitive photodiode. Beam 7 is one of a plurality of beams extending horizontally across the lift car door opening, thereby providing a multi-beam curtain. Circuitry (not shown) connected to receivers 8 is triggered by interception of beams 7 as a passenger enters the lift. This prevents door closure as explained above.

Auxiliary transmitters 9 and receivers 10, which may be similar infrared diodes, are located in the respective strips 4 and 5. The auxiliary transmitters 9 transmit respective secondary beams of (e.g.) infrared radiation, but these beams are not directly received by the receivers (since they are not located on the optical paths of the transmitters 9). Secondary beam 11 is radiated at an angle (e.g. about 45°) from the primary beam axis 7 towards a zone in front of the landing doors 3. In the absence of any object, such as passenger 12, no reflection of the secondary beams is received by auxiliary receivers 10*a*, 10*b*, 10*c*. However, when a passenger 12 enters detection zone 13, which is represented by overlapping fields of view of transmitter 9 and receiver 10, (receiver 10 being similarly angled e.g. at about 45° to the primary beam axis 7) secondary beam 11 will fall on the passenger's body and reflected radiation 14 will be received by one or more of the auxiliary receivers 10*a*, 10*b*, 10*c*. Consequently, even though passenger 12 has not intercepted primary beams 7, the auxiliary receivers 10 will operate to trigger the circuitry to prevent door closure.

The transmitters 9 and receivers 10 are preferably staggered as shown in FIG. 2, by arranging them at different heights above floor level. As shown in the drawing, receiver 10*a* is located mid-way between transmitters 9*a*, 9*b* (and so on) as shown in FIG. 2. The staggered relationship helps to prevent any spurious response by secondary beam receivers 10*a*–10*c*, otherwise due to receiving directly any secondary beam radiation. However, this does not prevent the auxiliary receivers from receiving secondary beam radiation reflected from an object, because this radiation is reflected at different angles (i.e. scattered by a passenger's body, or other object) and some will enter one or more of the secondary beam receivers 10*a*–10*c*.

Masks or shields 15 are located adjacent each of the auxiliary transmitters and receivers 9,10 so as to shield them from primary beam radiation. The auxiliary receivers 10 are also angled away from the path 7 of the primary beam and, in view of this, and the use of shields, the auxiliary receivers are arranged so as not to receive any direct primary radiation.

The principle described above, i.e. of using secondary beam as well as primary beam radiation may be used with circuitry of various types, as long as the secondary beam reflected signals are used to trigger means for preventing premature door closure as explained above. However, a brief description will now be given of circuitry, as shown in FIG. 3, which has been used in a preferred embodiment of the invention. FIG. 3 is a schematic block diagram which represents a simplified version of a preferred detector system. In practice, many of the functions would be performed by appropriate software running on a micro controller at the core of the control circuit, but these functions are shown in an equivalent "hardware" version in FIG. 3 (for the sake of explanation).

In operation, beam multiplexer 16 is used as a "master clock" of the system and it determines which detection function is operating and which beam of a radiation pattern is selected. These detection functions are broadly those associated with use of the primary beam, or secondary beam. For example, in a primary beam mode, a group of transmitting diodes 6 are turned on and the equivalent group of receiving diodes 8 are activated so as to receive primary beam radiation and to develop a trigger signal if the primary beam is intercepted. There may be, for example, five groups each having eight diode transmitting and receiver pairs, each group being consecutively switched on, in turn, so as to scan through a total of 40 primary beam diode pairs. After scanning the five groups of primary beam diode pairs, the secondary beam diode pairs (or auxiliary transmitters and receivers) are scanned. In this case, all of the auxiliary transmitters 9 and receivers 10 are switched on, because it is not necessary to scan the auxiliary diode pairs separately (or in groups). There may be, for example, three diode pairs in the secondary beam system. Thus, a cycle may be completed in which five groups of primary diodes and one group of secondary diodes is scanned or monitored, before the cycle is repeated. Different scanning patterns can be used in accordance with requirements.

When multiplexer 16 selects the direct or primary beam pattern, the output of the selected groups of transmitting diodes modulated with (e.g.) a square wave of approximately 15 Khz, and the corresponding receiving diodes 8 are monitored by connecting the beam to receiving amplifier 17. The output of amplifier 17 is fed to a synchronous detector 20, via a gain control circuit 18, where the signal is rectified and converted into a D.C. voltage, which is proportional to the received signal strength. During a scan cycle, when the groups of primary beam diode receivers are sequentially monitored, a signal level monitor 18 accumulates an "average" received signal level. If this average value is more or less than a preset threshold, it is used to change the gain control 18 to bring the average into the acceptable "window" of voltage. Any beams which still fall outside this window (on the low end) are regarded as "blocked". A "direct beam loss" detector 20 generates a signal to tell an "obstruction detected relay driver" 21 to switch the door motor output to "STOP" or "REVERSE" thereby preventing door closure.

When the multiplexer 16 selects the secondary or reflected beam system, signal level monitor 19 then "remembers" the gain set when the primary or direct beams were used and thereby provide some indication of the (closing) door aperture width. This "remembered" gain is used as a reference for monitor 19 to preset the gain control 18 to suit known characteristics of the reflective system and thereby avoid having too much or too little gain for successfully detecting obstruction 12 within the reflective beam convergence zone 17. This feedback of information from the direct or primary beam system therefore enables successful operation of the reflective system in the preferred embodiment of the invention. In other words, the signal from the primary beam system is used so as to reduce the gain or sensitivity of the secondary beam detecting system so that door closure is not accidentally prevented by the receipt of radiation other than that reflected or scattered by the object in the convergent zone 13.

If a reflective obstruction is present in zone 13, then the reflected signal which is processed by amplifier 17, gain control 18 and synchronous detector 24, will exceed a preset "trigger" threshold and a "reflected beam increase detector" 22 will respond by activating relay driver 21 to prevent door closure. As a person could be in the convergence zone 13 but not be wanting to enter the lift car, a "time out" function device 23 can be actuated after a short delay, to allow the doors to close normally. Alternatively, breaking of the direct beam pattern 7 can be used as a signal that passengers are entering or leaving the car, so that triggers from the reflective detector (which uses beams 12,14) can be acted upon, or ignored, as appropriate. For example, if a passenger leaves the car, the direct beams are broken first and the next reflected detection ignored (due to the passenger leaving the lift car). In another circumstance, a trigger from the reflective detector which is not followed within two seconds (for example) by a trigger from the direct detector can be ignored as spurious and the reflective system briefly disabled to prevent a delay in the car movement. In short, the reflective system (12,14) is only necessary during the early part of door closure, because it would not be possible for a passenger to enter the lift car, once the doors have closed by a certain amount. Therefore, the secondary beam system can, in effect, be switched off, or desensitised, after the doors have closed by a certain amount (e.g. half closed) to prevent the secondary beam detectors (10) from responding to spurious radiation (since the level of radiation will increase as the doors close), thereby unnecessarily preventing door closure. This would prevent the doors from apparently bouncing open and closed due to spurious radiation effects.

Although one form of circuitry has been described above, this is merely an example of how the principle of the invention can be used, and other circuits may embody the principles of the invention whilst not using all of the features described with reference to FIG. 3.

I claim:

1. In a lift installation comprising:

a lift car having a pair of sliding doors which move towards one another across a lift car door opening;

a hoistway in which the lift car moves between floors, the hoistway having at least one sliding landing door on each floor, an infrared radiation primary beam system including:

(a) primary beam transmitter means for transmitting at least one primary beam across the lift car door opening;

(b) primary beam receiver means for receiving the at least one primary beam, said primary beam receiver means being responsive to interception of said at least one primary beam by an object to provide a primary beam signal;

an infrared radiation secondary beam system including:

(c) secondary beam transmitter means for transmitting a secondary beam of radiation into a detection zone outside the lift car and in front of the at least one sliding landing door;

(d) secondary beam receiver means for receiving a reflection of said secondary beam from a body in the detection zone, said secondary beam receiver means providing a secondary beam signal;

said primary beam and said secondary beam transmitter means being adjacent a closing edge of one of said sliding doors of the lift car; said primary beam and said secondary beam receiver means being adjacent to a closing edge of the other one of said sliding doors of the lift car;

said secondary beam receiver means being arranged so that said secondary beam receiver means does not respond to any direct secondary beam radiation from said secondary beam transmitter means which could otherwise prevent door closure; and circuitry responsive to said primary beam signal or to said secondary beam signal for preventing door closure; said circuitry including a gain adjuster responsive to strength of the primary beam signal, for adjusting gain in processing secondary beam signals, the gain being adjusted so as to reduce sensitivity of the secondary receiver means to spurious signals, as the sliding doors of the lift car close.

2. The lift installation according to claim 1, further including means for timing out response of said secondary beam system to allow the doors of the lift car to close normally, after a predetermined delay, if an object is stationary in the detection zone.

3. The lift installation according to claim 2, further including means for ignoring the response of said secondary beam system when the doors of the lift car have closed by a predetermined amount.

4. The lift installation according to claim 1, further including means for ignoring response of the secondary beam system, (i) when an object has first intercepted any of said at least one primary beam and then entered the detection zone, on leaving the lift car, and (ii) if the response of said secondary beam receiver means is not followed by a response from said primary beam receiver means within a, predetermined period.

5. The lift installation according to claim 4, further including means for ignoring the response of said secondary beam system when the doors of the lift car have closed by a predetermined amount.

6. A lift installation according to claim 1 wherein the secondary beam transmitter means and secondary beam receiver means are disposed in a relatively staggered relationship.

7. A lift installation according to claim 1 wherein each secondary beam transmitter means and secondary beam receiver means has a field of view which is inclined at an angle to a plane of the lift car door opening.

8. A lift installation according to claim 7 wherein directional axes of the secondary beam transmitter means and secondary beam receiver means are inclined at approximately 45° to the plane of the lift car door opening.

9. A lift installation according to claim 7 which comprises two or more groups of secondary beam transmitters and secondary beam receivers, the directional axes of each group being at a different angle to the plane of the lift car door opening.

10. A lift installation according to claim 1 where shields are provided adjacent the secondary beam transmitter means and secondary beam receiver means so as to prevent any secondary beam radiation from being received directly.

11. A lift installation according to claim 1 wherein the primary beam transmitter means and secondary beam transmitter means are located, in a spaced vertical array on one side of the lift car door opening, and the primary beam receiver means and secondary beam receiver means are located in a spaced vertical array on the other side of the lift car door opening.

12. In a lift installation comprising:

a lift car having a sliding door which moves across a lift car door opening towards a door post;

a hoistway in which the lift car moves between floors, the hoistway having at least one sliding landing door on each floor;

an infrared radiation primary beam system including:

(a) primary beam transmitter means for transmitting at least one primary beam across the lift car door opening;

(b) primary beam receiver means for receiving the at least one primary beam, said primary beam receiver means being responsive to interception of said at least one primary beam by an object to provide a primary beam signal;

an infrared radiation secondary beam system including:

(c) secondary beam transmitter means for transmitting a secondary beam of radiation into a detection zone outside the lift car and in front of the at least one sliding landing door;

(d) secondary beam receiver means for receiving a reflection of said secondary beam from a body in the detection zone, said secondary beam receiver means providing a secondary beam signal;

said primary beam and said secondary beam transmitter and receiver means being respectively fitted to a closing edge of said sliding door and to said door post;

said secondary beam receiver means being arranged so that said secondary beam receiver means does not respond to any direct secondary beam radiation from said secondary beam transmitter means which could otherwise prevent door closure; and circuitry responsive to said primary beam signal or to said secondary beam signal for preventing door closure; said circuitry including a gain adjuster responsive to strength of the primary beam signal, for adjusting gain in processing secondary beam signals, the gain being adjusted so as to reduce sensitivity of the secondary receiver means to spurious signals, as the door of the lift car closes.

13. The lift installation according to claim 12, further including means for timing out response of said secondary beam system to allow the door of the lift car to close normally, after a predetermined delay, if an object is stationary in the detection zone.

14. The lift installation according to claim 13, further including means for ignoring the response of said secondary beam system when the door of the lift car has closed by a predetermined amount.

15. The lift installation according to claim 12, further including means for ignoring response of the secondary beam system, (i) when an object has first intercepted any of said at least one primary beam and then entered the detection zone, on leaving the lift car, and (ii) if the response of said secondary beam receiver means is not followed by a response from said primary beam receiver means within a predetermined period.

16. The lift installation according to claim 15, further including means for ignoring the response of said secondary beam system when the door of the lift car has closed by a predetermined amount.

17. Apparatus for fitment to a lift car having a pair of sliding doors which move towards one another across a lift car door opening; the apparatus including:

(a) a first array of infrared radiation transmitters for fitment adjacent a closing edge of one of the sliding doors and for transmitting primary beams of radiation across the lift car door opening;

(b) a first array of infrared receivers for fitment adjacent a closing edge of the other one of the sliding doors for receiving said primary beams, said first array of infrared receivers being responsive to interception of said primary beams by an object to provide a primary beam signal;

(c) a second array of infrared transmitters for fitment adjacent a closing edge of one of the sliding doors and for transmitting secondary beams of radiation into a detection zone outside the lift car and in front of a landing door or doors of a hoistway;

(d) a second array of infrared receivers for fitment adjacent a closing edge of the other one of the sliding doors for receiving the secondary beams when reflected from a body in the detection zone, said second array of infrared receivers providing a secondary beam signal;

said second array of infrared receivers being arranged so that it does not respond to any direct secondary beam radiation from the second array of infrared transmitters which could otherwise prevent door closure; and circuitry for fitment to the lift car and which is responsive to said primary beam signal or to said secondary beam signal for preventing door closure; said circuitry including a gain adjuster and means for processing secondary beam signals, said gain adjuster being responsive to strength of the primary beam signal, which is output from the first array of infrared receivers as the sliding doors close, for reducing gain in said means for processing secondary beam signals, the gain being reduced so as to reduce sensitivity of the second array of infrared receivers to spurious signals as the sliding doors close.

18. Apparatus for fitment to a lift car having a sliding door which move towards a door post across a lift car door opening; the apparatus including:

(a) a first array of infrared radiation transmitters for fitment adjacent a closing edge of the sliding door and for transmitting primary beams of radiation across the lift car door opening;

(b) a first array of infrared receivers for fitment to the door post and for receiving said primary beams, said first array of infrared receivers being responsive to interception of said primary beams by an object to provide a primary beam signal;

(c) a second array of infrared transmitters for fitment adjacent the closing edge of the sliding door and for transmitting secondary beams of radiation into a detection zone outside the lift car and in front of a landing door or doors of a hoistway;

(d) a second array of infrared receivers for fitment to the door post for receiving said secondary beams when reflected from a body in the detection zone, said second array of infrared receivers providing a secondary beam signal;

each of said second array of infrared receivers being arranged so that it does not respond to any direct secondary beam radiation from the second array of infrared transmitters which could otherwise prevent door closure; and circuitry for fitment to the lift car and which is responsive to said primary beam signal or to said secondary beam signal for preventing door closure; said circuitry including a gain adjuster and means for processing secondary beam signals, said gain adjuster being responsive to strength of the primary beam signal, which is output from the first array of infrared receivers as the sliding door closes, for reducing gain in said means for processing secondary beam signals, the gain being reduced so as to reduce sensitivity of the second array of infrared receivers to spurious signals as the sliding door closes.

19. A lift installation comprising:

a lift car having a pair of sliding doors which move towards one another across a lift car door opening;

a hoistway in which the lift car moves between floors, the hoistway having at least one sliding landing door on each floor, an infrared radiation primary beam system including:

(a) primary beam transmitter means for transmitting at least one primary beam across the lift car door opening;

(b) primary beam receiver means for receiving the at least one primary beam, said primary beam receiver means being responsive to interception of said at least one primary beam by an object to provide a primary beam signal;

an infrared radiation secondary beam system including:

(c) secondary beam transmitter means for transmitting a secondary beam of radiation into a detection zone outside the lift car and in front of the at least one sliding landing door;

(d) secondary beam receiver means for receiving a reflection of said secondary beam from a body in the detection zone, said secondary beam receiver means providing a secondary beam signal;

said primary beam and said secondary beam transmitter means being adjacent to a closing edge of one of said sliding doors of the lift car; said primary beam and said secondary beam receiver means being adjacent to a closing edge of the other one of said sliding doors of the lift car;

said secondary beam receiver means being arranged so that said secondary beam receiver means does not respond to any direct secondary beam radiation from said secondary beam transmitter means which could otherwise prevent door closure; and circuitry responsive to said primary beam signal or to said secondary beam signal for preventing door closure.

* * * * *